US007868837B2

(12) United States Patent
Yun et al.

(10) Patent No.: US 7,868,837 B2
(45) Date of Patent: Jan. 11, 2011

(54) ULTRA ISOLATION ANTENNA

(75) Inventors: Je-hoon Yun, Daejeon (KR); Jong-sik Lim, Daejeon (KR); Jung-ick Moon, Daejeon (KR); Chang-joo Kim, Daejeon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 735 days.

(21) Appl. No.: 11/722,272

(22) PCT Filed: Dec. 21, 2005

(86) PCT No.: PCT/KR2005/004425

§ 371 (c)(1),
(2), (4) Date: Aug. 14, 2007

(87) PCT Pub. No.: WO2006/068416

PCT Pub. Date: Jun. 29, 2006

(65) Prior Publication Data

US 2009/0267849 A1 Oct. 29, 2009

(30) Foreign Application Priority Data

Dec. 21, 2004 (KR) ..... 10-2004-0109401

(51) Int. Cl.
*H01Q 21/00* (2006.01)

(52) U.S. Cl. ..... 343/727

(58) Field of Classification Search ..... 343/727, 343/841, 895, 844, 846
See application file for complete search history.

(56) References Cited

U.S. PATENT DOCUMENTS 5,231,407 A * 7/1993 McGirr et al. ..... 343/700 MS
5,826,201 A * 10/1998 Gratias ..... 455/575.5
5,952,983 A 9/1999 Dearnley et al.
6,531,984 B1 3/2003 Johannisson et al.
6,542,131 B1 * 4/2003 Haapanen ..... 343/813
7,369,095 B2 * 5/2008 Hirtzlin et al. ..... 343/853

(Continued)

FOREIGN PATENT DOCUMENTS

EP 0 056 985 A2 8/1982

(Continued)

OTHER PUBLICATIONS

S.L. Karode, et al; "Dual Polarised Microstrip Patch Antenna Using Feedforward Isolation Enhancement for Simultaneous Transmit/Receive Application;" National Conference on Antennas and Propagation: Mar. 30-Apr. 1, 1999, Conference Publication No. 461.

(Continued)

*Primary Examiner*—Huedung Mancuso
(74) *Attorney, Agent, or Firm*—Ladas & Parry LLP

(57) ABSTRACT

Provided is a transmitting/receiving isolation antenna that can perform wireless bi-directional communication in the co-channel, co-polarization and co-time by acquiring high isolation from transmitting and receiving antennas having co-time, co-channel and co-polarization and set up adjacently. The isolation antenna includes a first antenna; second and third antennas symmetrically positioned in the same distance from the first antenna; a shielding unit symmetrically positioned between the first and second antennas, and between the first and third antennas; and a signal removing unit for removing a signal transmitted from the first antenna to the second and third antennas.

16 Claims, 6 Drawing Sheets

U.S. PATENT DOCUMENTS

| | | | | |
|---|---|---|---|---|
| 7,525,502 | B2 * | 4/2009 | Hui et al. | 343/835 |
| 2002/0135523 | A1 | 9/2002 | Romero et al. | |

FOREIGN PATENT DOCUMENTS

| | | | |
|---|---|---|---|
| JP | 55-137703 | A | 10/1980 |
| JP | 04-140906 | A | 5/1992 |
| KR | 100192375 | | 1/1999 |
| KR | 1020020046238 | | 6/2002 |
| KR | 1020030021977 | | 3/2003 |
| KR | 1020030065609 | | 8/2003 |
| KR | 1020040027389 | | 4/2004 |
| KR | 1020040091343 | | 10/2004 |
| WO | WO02/41451 | | 5/2002 |

OTHER PUBLICATIONS

Y. Hao, et al; "Isolation Enhancement of PBG Microstrip Diplexer Patch Antenna;" 11th International Conference on Antennas and Propagation, Apr. 17-20, 2001, Conference Publication No. 480.

R. Benjamin et al; "Symmetric-pair antennas for beam steering, direction finding or isotropic-reception gain" IEE Proceedings H. Microwaves, Antennas & Propagation, Institution of Electrical Engineers. Stevenage, GB, vol. 138, No. 4, Aug. 1, 1991, pp. 368-374, XP000260857.

R.B. Dybdal, et al; "Time-Compensated Adaptive Interference Cancellation" IEEE AP&S Symposium, vol. 1, Jun. 15-19, 1987, pp. 74-77, XP002486602.

European Search Report dated Jul. 15, 2008; Application No./Patent No. 05822124.3-1248 / 1829160 PCT/KR2005004425.

* cited by examiner

[Fig. 1]
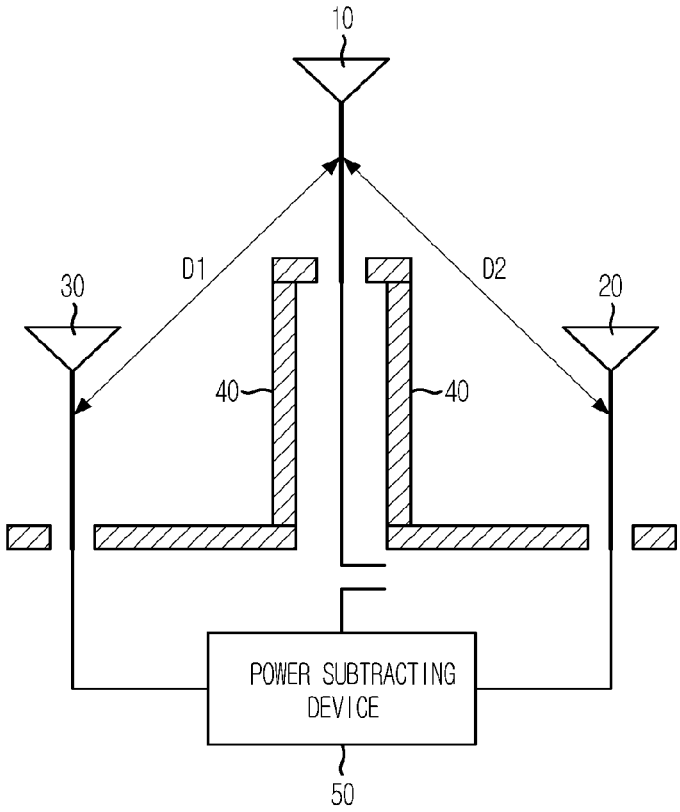
[Fig. 2]
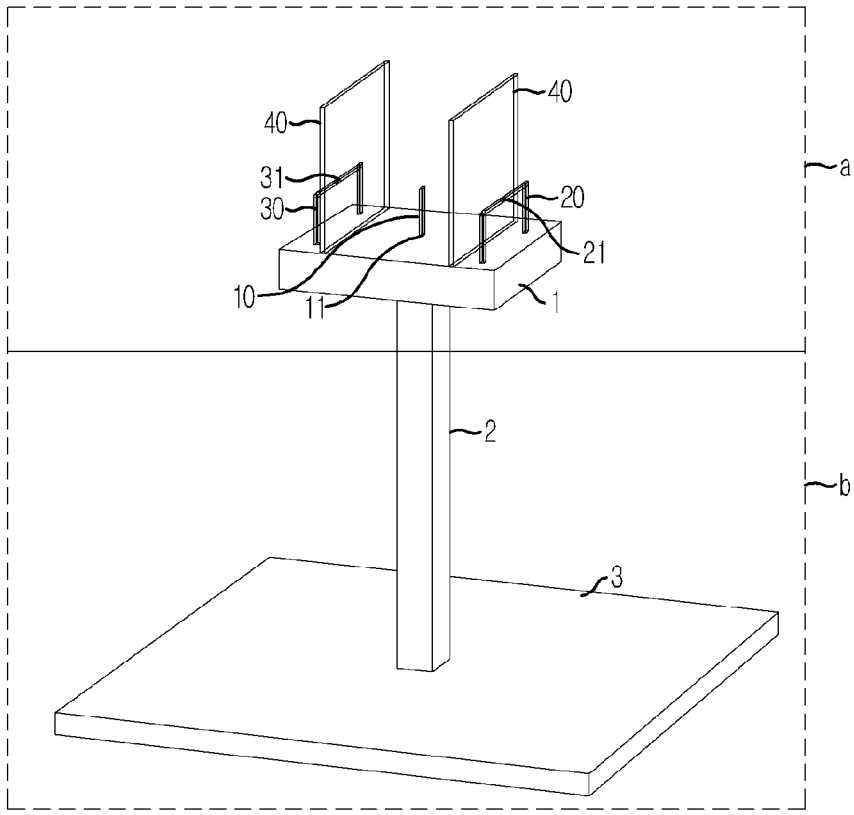

[Fig. 3]
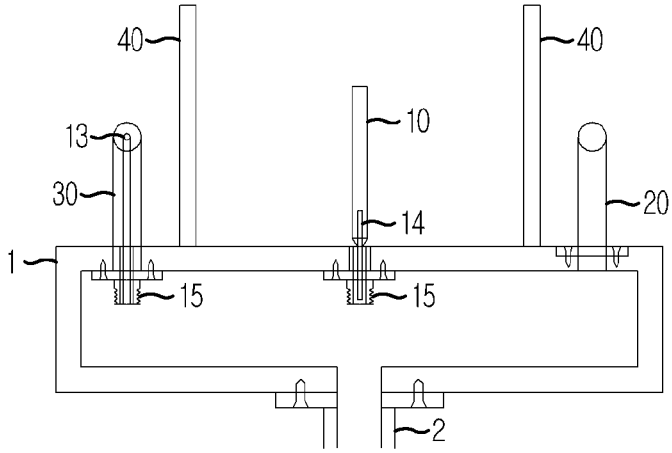
[Fig. 4]
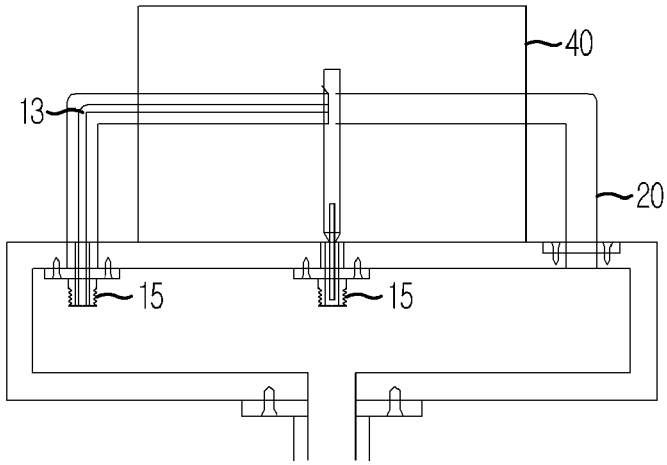
[Fig. 5]
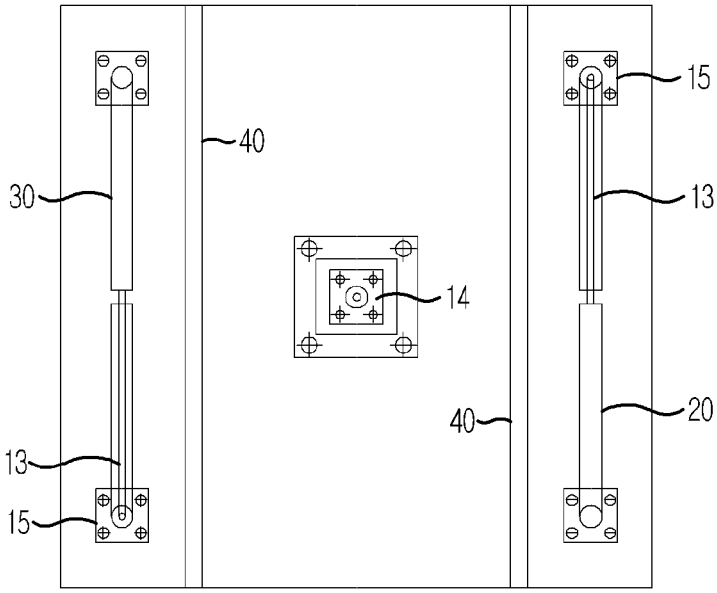

[Fig. 6]
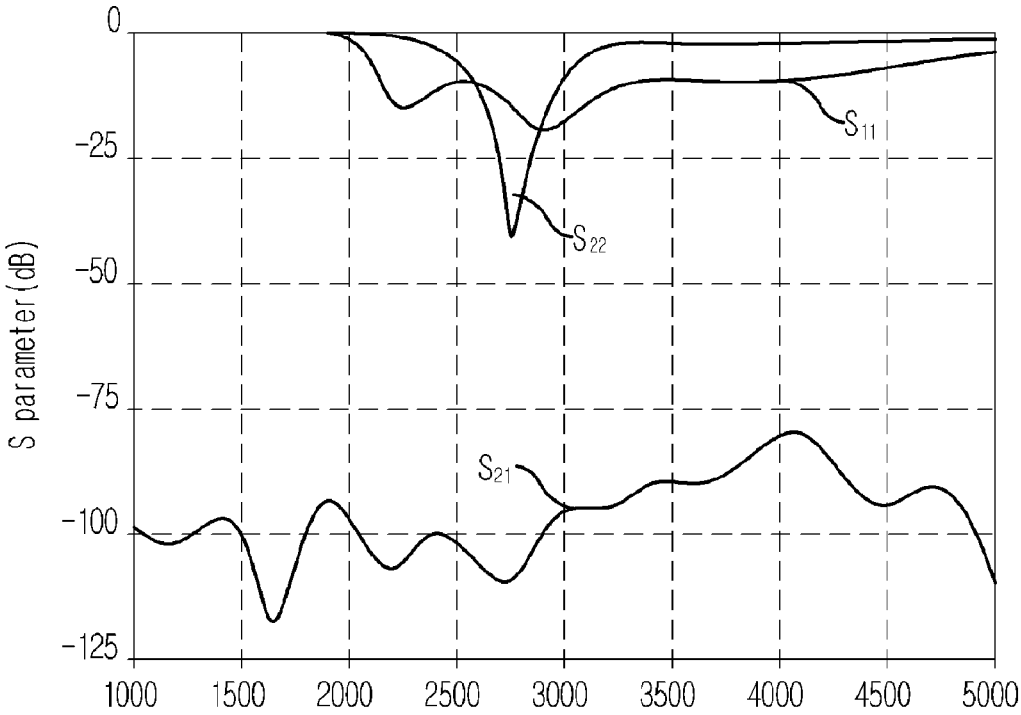
[Fig. 7]
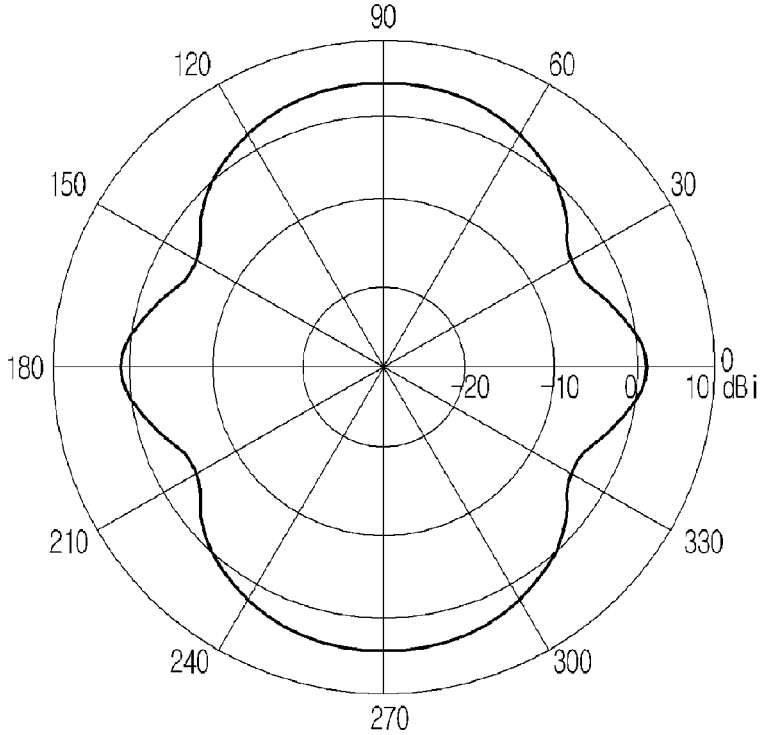

[Fig. 8]
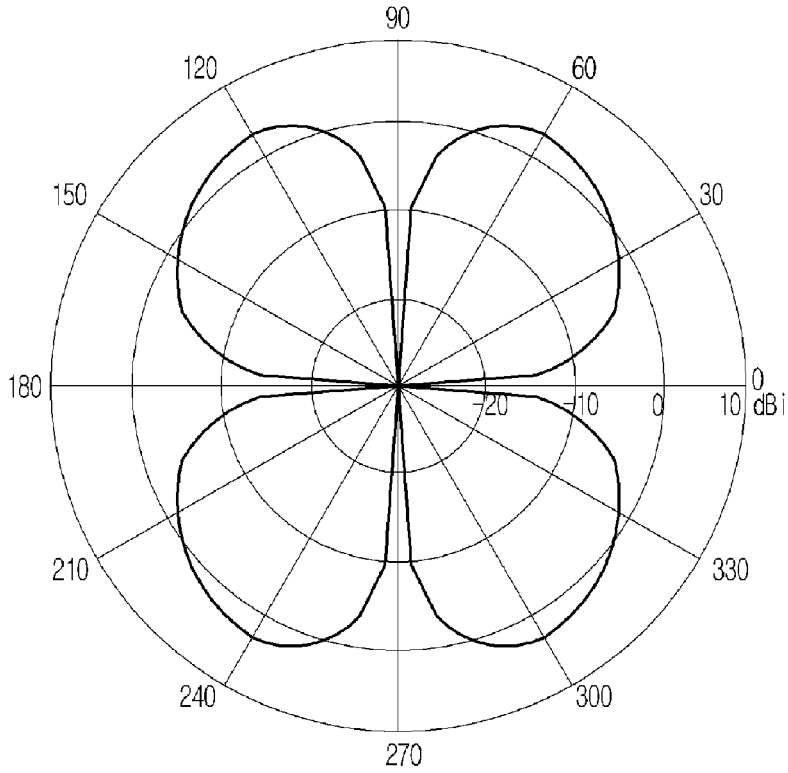
[Fig. 9]
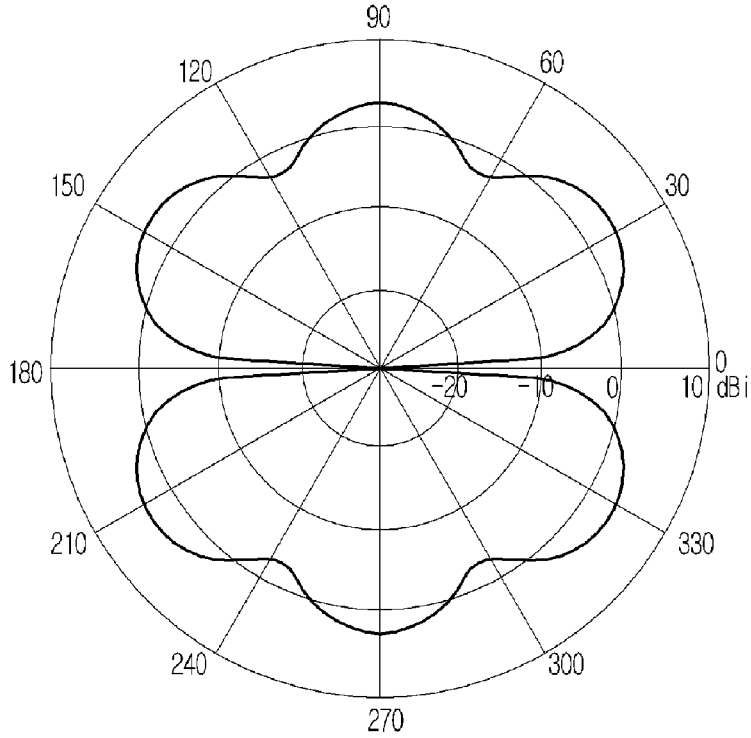

[Fig. 10]
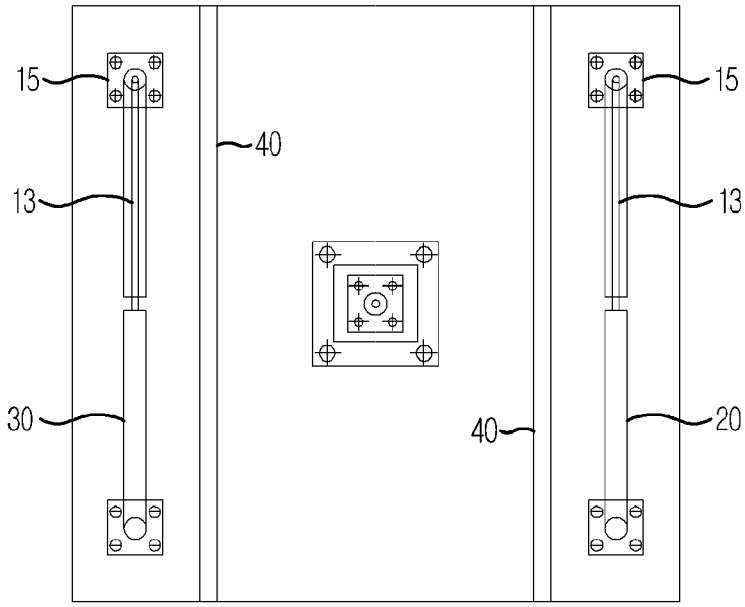
[Fig. 11]
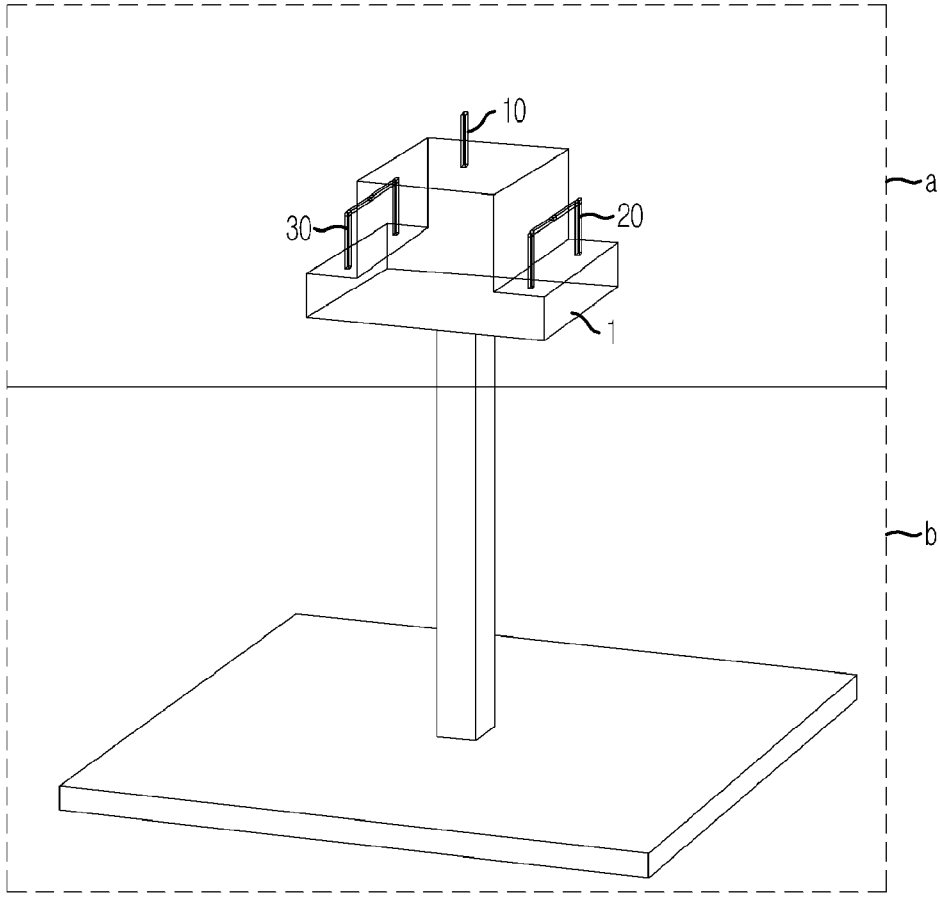

[Fig. 12]
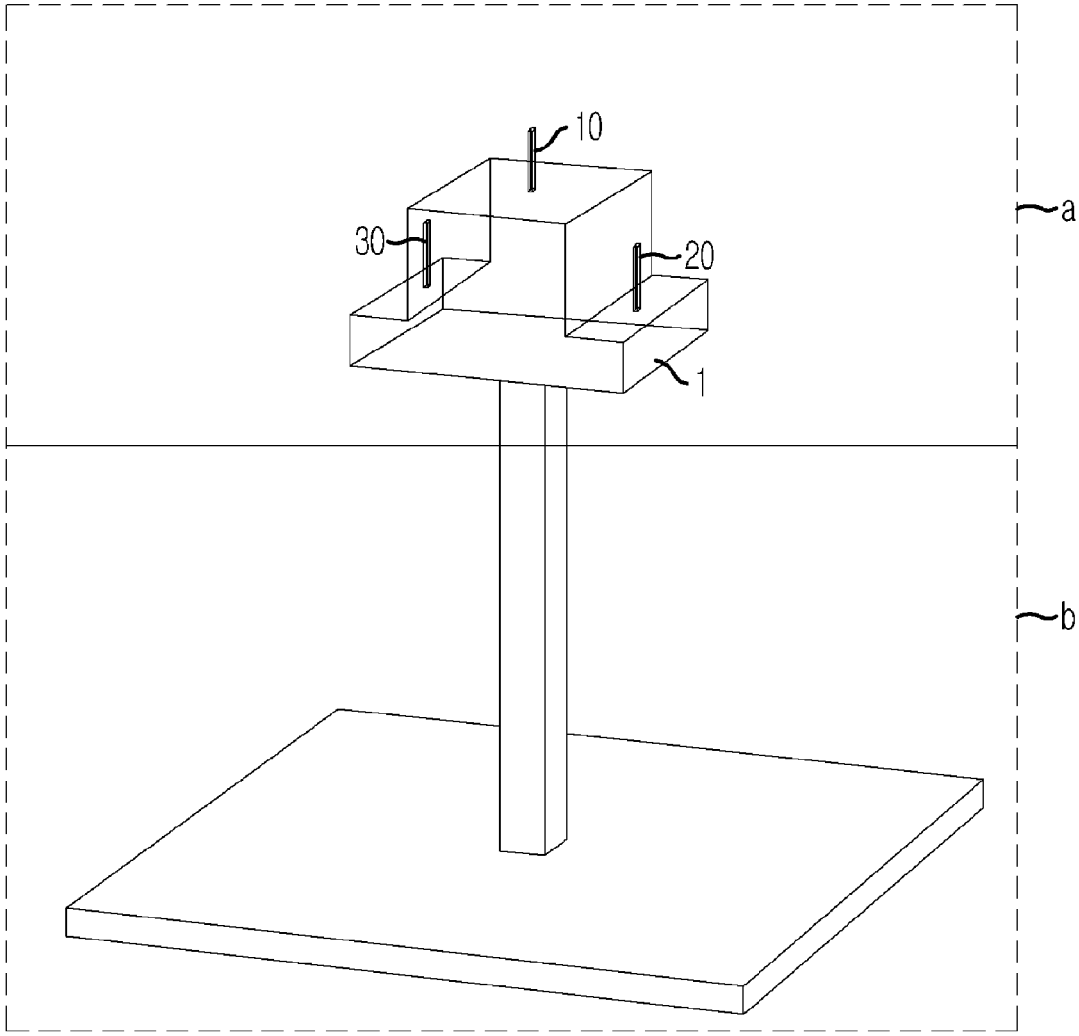

ULTRA ISOLATION ANTENNA

TECHNICAL FIELD

The present invention relates to an ultra isolation antenna; and, more particularly, to a transmitting/receiving isolation antenna used in a co-channel bi-directional repeater.

BACKGROUND ART

A wireless technology for isolating transmitting/receiving signals from an antenna in a co-channel has been studied for a long time in a repeater field. Repeaters can be classified into a mono-directional repeater, in which receiving and transmitting directions are different from each other, and a bi-directional repeater, in which receiving and transmitting directions are the same.

There should be a technological difference that antennas used in the co-channel mono-directional repeater are set up for different directivity, and antennas used in the bi-directional repeater are set up in such a manner that the entire or part of their directivity is overlapped.

The bi-directional repeater is a bi-directional wireless communication system. The bi-directional repeater receives a signal transmitted from a transmitting antenna in a repeater, restores amplitude of the signal, and transmits the signal through a co-channel in a region including the transmitting antenna. It is preferred to perform isolation based on a co-channel bi-directional wireless communication technology rather than a repeater technology since the transmitting antenna takes the received signal as receiving information and the signal can include speech or image information of a user.

An ultra isolation antenna suggested in the present invention is defined as an antenna capable of acquiring isolation more than a minimum level that can be used in a wireless communication field. Herein, the minimum isolation level is an isolation level for co-channel which is more than 120 dB in a mobile communication such as a cellular and a personal communication device.

When the co-time, co-channel and co-polarization bi-directional communication technology is realized based on a conventional isolation antenna technology, there is a problem that it is difficult to identify a transmitting signal and a receiving signal from each other since a reflected wave for a transmitting signal and a receiving signal are simultaneously transmitted from a receiving end to a receiver.

Conventional methods for solving the above problems are represented by two methods. One is a Frequency Division Duplex (FDD) method for performing communication by separating and using the transmitting frequency and the receiving frequency, that is, channels are set up differently. The other is a Time Division Duplex (TDD) method for separating and using transmitting time and receiving time. That is, the transmitting signal and the receiving signal are separated and used.

However, since the former method is not the co-channel bi-directional communication method and the latter method is not the co-time bi-directional communication method, there is a problem that communication capacity is reduced.

There is a technology for generating a transmitting signal and a receiving signal, whose polarizations are perpendicular to each other, by vertically setting two power feeders in a patch antenna, and maintaining isolation between the two feeders, as another conventional technology, which is not applied to an application system. The technology is proposed in an article by Karode, *IEE National Conference on Antennas and Propagation*, pp. 49-52, April 1999.

Also, Hao has suggested an isolation technology by changing polarization generation of a patch antenna applying a photo band gap (PBG) structure in an article, *IEE, 11th International Conference on Antenna Propagation*, pp. 86-89, April 2001.

However, as suggested in the result, isolation for a transmitting/receiving signal is very low in the same frequency. Thus, there is a problem that the above technology is not proper as an antenna for a co-channel bi-directional communication in diverse mobile communication, local communication, a broadcasting repeater and a satellite communication field requiring high isolation in the same frequency.

In the result of the conventional technologies suggested by Karodo and Hao, isolation of less than about 60 dB is acquired although transmitting/receiving frequency band or polarization is different.

Therefore, it is very difficult to realize a technology of an ultra isolation antenna which can be used in a co-channel bi-directional wireless communication system requiring ultra isolation more than 120 dB in the same polarization and same channel.

DISCLOSURE OF INVENTION

Technical Problem

It is, therefore, an object of the present invention to provide an ultra isolation antenna capable of a co-channel, co-polarization and co-time bi-directional wireless communication by setting up a transmitting antenna and a receiving antenna having the co-time, a co-channel, a co-polarization in mobile communication, satellite communication, bi-directional broadcasting and a local communication fields to thereby acquire high isolation.

Other objects and advantages of the invention will be understood by the following description and become more apparent from the embodiments in accordance with the present invention, which are set forth hereinafter. It will be also apparent that objects and advantages of the invention can be embodied easily by the means defined in claims and combinations thereof.

Technical Solution

In accordance with one aspect of the present invention, there is provided a transmitting/receiving ultra isolation antenna for maintaining high isolation between a transmitting signal and a receiving signal, including: a first antenna; a second and a third antennas which are symmetrically positioned in a same distance from the first antenna; a shielding unit symmetrically positioned between the first and second antennas and between the first and third antennas; and a reflection signal removing unit for removing a signal transmitted to the second and third antennas from the first antenna.

In accordance with another aspect of the present invention, there is provided a transmitting/receiving ultra isolation antenna for maintaining high isolation between a transmitting signal and a receiving signal, including: a first antenna; a second and a third antenna, which are symmetrically positioned in a same distance from the first antenna; a shielding box which is positioned in a lower part of the first antenna, the second antenna, and the third antenna and has a structure shielded by electric conductor; and a reflection signal removing unit for removing a signal transmitted from the first antenna to the second and third antennas.

ADVANTAGEOUS EFFECTS

The present invention can realize high isolation of more than 140 dB in the same channel and the same polarization, i.e., co-channel and co-polarization by using three antenna devices.

Also, the technology of the present invention can be applied to an antenna for realizing co-channel, co-polarization and co-time bi-directional wireless communication of in a repeater, which includes wireless local area network (LAN), personal area network (PAN) and ultra-wideband (UWB), a Radio Frequency Identification (RFID) reader, and a mobile/satellite bi-directional communication system.

Also, the present invention can provide an antenna system and a relay system capable of simultaneous bi-directional communication in a co-channel which can form a wireless communication system, performance of which is remarkably improved in comparison with frequency division duplex (FDD) and time division duplex (TDD) methods in the respect of using existing frequencies.

BRIEF DESCRIPTION OF THE DRAWINGS

The above and other objects and features of the present invention will become apparent from the following description of the preferred embodiments given in conjunction with the accompanying drawings, in which:

FIG. 1 is a diagram showing an ultra isolation antenna in accordance with a first embodiment of the present invention;

FIG. 2 is a perspective view showing an ultra isolation antenna in accordance with a second embodiment of the present invention;

FIG. 3 is a cross-sectional front view of an antenna device in accordance with the first embodiment of the present invention;

FIG. 4 is a cross-sectional side view of an antenna device in accordance with the embodiment of the present invention;

FIG. 5 is a cross-sectional plane view of an antenna device in accordance with the embodiment of the present invention;

FIG. 6 is a graph showing an S parameter characteristic of the ultra isolation antenna in accordance with the second embodiment of the present invention;

FIG. 7 is a diagram showing a far-field radiation pattern of a perpendicular element in an H plane when a first antenna of the ultra isolation antenna is fed in accordance with the second embodiment of the present invention;

FIG. 8 is a diagram showing a far-field radiation pattern of a perpendicular element in an H plane when a power summating device is connected to terminals 2 and 3 of the ultra isolation antenna in accordance with the second embodiment of the present invention;

FIG. 9 is a diagram showing a far-field radiation pattern of a perpendicular element in an H plane of =100 when a power subtracting device is connected to the terminals 2 and 3 of the ultra isolation antenna in accordance with the second embodiment of the present invention;

FIG. 10 is a cross-sectional plane view showing an ultra isolation antenna in accordance with a third embodiment of the present invention;

FIG. 11 is a perspective view showing an ultra isolation antenna in accordance with a fourth embodiment of the present invention; and FIG. 12 is a perspective view showing an ultra isolation antenna in accordance with a fifth embodiment of the present invention.

MODE FOR THE INVENTION

Other objects and advantages of the present invention will become apparent from the following description of the embodiments with reference to the accompanying drawings. Therefore, those skilled in the art that the present invention is included can embody the technological concept and scope of the invention easily. In addition, if it is considered that detailed description on prior art may blur the points of the present invention, the detailed description will not be provided herein. The preferred embodiments of the present invention will be described in detail hereinafter with reference to the attached drawings.

FIG. 1 is a diagram showing an ultra isolation antenna in accordance with a first embodiment of the present invention.

As shown in FIG. 1, the ultra isolation antenna of the present invention includes a first antenna 10, a second antenna 20, a third antenna 30, a shielding unit 40 and a power subtracting device 50.

The configuration of the ultra isolation antenna of the present invention will be described in detail hereinafter.

In the ultra isolation antenna of the present invention, a center of the antenna is the first antenna 10, and the distances D1 and D2 from the first antenna to the second antenna 20 and the third antenna 30 are the same and symmetrical. The shielding unit 40 formed of a conductor or a shielding substance is symmetrically set up in the center between the second antenna 20 and the third antenna 30.

Herein, the signal transmitted from the first antenna 10 to the second antenna 20 and the third antenna 30 is removed by equally making the length of coaxial cable connected to the second antenna 20 and the third antenna 30 and connecting to the power subtracting device 50 realized as a 180 hybrid combiner. The power subtracting device 50 can apply a power summating device based on a feeding direction of the second antenna 20 and the third antenna 30.

Therefore, it is possible to improve isolation characteristic with no regard to a kind of antennas.

As to be described in the following embodiment, when the first antenna 10 is a dipole antenna and the second and third antennas 20 and 30 positioned in opposite to a feeding direction, in which a connector inter core and an antenna device are connected in a feeding structure, the monopole antenna radiates an electric field to a neighboring region, and the loop antennas radiate a magnetic field to a neighboring region, thereby realizing much higher level of isolation.

It is possible to gain the same characteristic when the first antenna 10 is realized to be the loop antenna, and the second antenna and third antennas 20 and 30 as the monopole antennas.

When the first antenna 10 is set up to be monopole antenna and the second and third antennas 20 and 30 to be highly directional antennas, such as horn antennas, TEM horn antennas, a ridged horn antennas, log periodic antennas, Yagi-Uda antennas, and dipole antennas having a reflector, with their beam directed to be in opposite to each other, the quantity that signals are combined into the first antenna 10, which enhances isolation.

When the antennas are formed as the directional antennas, it is possible to symmetrically set up the shielding unit 40 between the second antenna 20 and the third antenna 30 and enhance isolation.

Also, when the first antenna 10 is formed to be a monopole antenna and the second and third antennas 20 and 30 are formed to be the dipole antennas, the power subtracting device 50 can be realized by using a power summating device such as a power distributor, an 180 hybrid combiner, a T connector by setting up the second antenna 20 and the third antenna 30 to have a different feeding direction.

FIG. 2 is a perspective view showing an ultra isolation antenna in accordance with a second embodiment of the present invention.

As shown in FIG. 2, the ultra isolation antenna of the present invention can be divided into an antenna device (a) for generating radiated electromagnetic wave or receiving electromagnetic wave and an antenna supporting unit (b) for supporting the antenna device.

In the antenna device (a), the first antenna 10 is set up in a monopole form in the center of a shielding box 1, which is sealed by an electric conductor such as gold, silver and aluminum and has a vacant space inside. The second antenna 20 and the third antenna 30 are symmetrically set up in the form of a loop antenna on the right and left sides based on the first antenna 10.

Both second antenna 20 and third antenna 30 are vertically set up as the soccer goalposts in the shielding box 1, and feeding units 21 and 31 are set up in the center of the loop antenna.

As shown in the drawing, a first antenna feeding unit 11, a second antenna feeding unit 21 and a third antenna feeding unit 31 are set up perpendicularly to one anther, thereby improving isolation with the first antenna.

The quantity of electromagnetic wave radiated from the first antenna 10 and combined to the second antenna 20 can be reduced by setting up the shielding unit 40 formed of metal including gold, silver, aluminum, iron, and copper between the first antenna 10 and the third antenna 30.

The quantity of electromagnetic wave radiated from the first antenna 10 and combined to the third antenna 30 can be reduced by setting up the shielding unit 40 formed of metal including gold, silver, aluminum, iron, and copper between the first antenna 10 and the third antenna 30.

Although the shielding unit 40 does not exist, a combination quantity among the first antenna 10, the second antenna 20 and the third antenna 30 is very low.

An antenna device supporting unit 2 manufactured to support the antenna device (a) is set up in the antenna supporting unit (b). One thing to pay attention is that the antenna device supporting unit 2 is set up in the center of the antenna device (a) as shown in the drawing. This is because the amplitude and phase of the radiated wave generated in the first antenna 10 to the second antenna 20 should be the same as the amplitude and phase transmitted to the third antenna 30, when the first antenna 10 is used as a transmitting antenna.

Therefore, the antenna device supporting unit 2 should be set up to maintain symmetry.

Symmetrically maintaining radiated wave plays a very important role in improvement of isolation.

An antenna support 3 set up on a ground should have the antenna device (a) and it should be able to stand up the antenna device supporting unit 2 on the ground. It is also preferred to maintain a symmetric characteristic of a structure of the antenna support 3 since it is preferred to have scattered wave reflected by a ground maintain symmetry.

In particular, when the size of the antenna device supporting unit 2 is small, the scattered wave should have a far more symmetrical structure since the scattered wave generated by ground affects on the isolation.

Also, a structure of the antenna support 3 can be manufactured in such shapes as rectangular square, rectangle and cylinder, and a cross-section of the antenna device supporting unit 2 can be manufactured in a shape of cylindrical pipe as well as a shape of a square pipe.

FIGS. 3 and 4 and 5 are a cross-sectional front view, a cross-sectional side view and a cross-sectional plane view of an antenna device in accordance with the first embodiment of the present invention, respectively.

The first antenna 10 is formed of an electric conductor such as gold, silver, copper and aluminum to be a monopole antenna. As shown in the drawing, the first antenna 10 is set up in the center of the shielding box 1. A coaxial connector 15 is set up in the inside of the shielding box 1 and a connector pin 14 is connected to the first antenna 10. That is, an input/output terminal should be connected from the inside of the shielding box 1.

The second antenna 20 is also manufactured to be a loop antenna made of an electric conductor such as gold, silver, copper, aluminum and includes a right angle loop antenna, which is grounded to the shielding box by dividing the loop antenna by half.

To set up the second antenna feeding unit 21, a left part of the second antenna 20 is set up by using sheath of the coaxial cable connected to a coaxial connector 15 in an inside of the shielding box 1, and an inside conductor 13 of the coaxial cable is connected to a right part of the second antenna 20 formed of a conducting wire.

Also, to set up the third antenna feeding unit 31, a right part of the third antenna 30 is set up by using sheath of the coaxial cable connected to the coaxial connector 15 in an inside of the shielding box 1, and the inside conductor 13 of the coaxial cable is connected to a left part of the third antenna 30 formed of a conducting wire.

That is, the second antenna 20 and the third antenna 30 are set up to have the coaxial cables in an opposite direction.

In case of a coaxial cable used to form the feeding units 21 and 31 in the second antenna 20 and the third antenna 30, the second antenna 20 and the third antenna 30 can be set up with a vacant metal pipe and fed by inserting the coaxial cable into the inside of the vacant metal pipe and using a coaxial connector. The above structure does not make any differences in performance.

Each of the connector 15 connected to the first antenna 10, the connector 15 connected to the second antenna 20 and the connector 15 connected to the third antenna 30 will be expressed as a terminal 1, terminal 2 and a terminal 3, respectively, hereinafter for the sake of convenience in explanation.

The terminals 2 and 3 are formed to have a phase difference delay by the length of the connected coaxial cable and connected to a power summating device such as a power distributor, a T connector and a 0 hybrid combiner. An output terminal of the power summating device will be referred to a terminal 4.

In case of delicate electromagnetic wave radiated from the first antenna 10 to the first and the third antennas 20 and 30, i.e., electromagnetic wave of the same phase/power, a signal transmitted to the terminals 2 and 3 has the same intensity and a phase difference of about 180 is generated since an inside pin of a coaxial cable set up in different directions from each other.

Therefore, the power summating device can enhance isolation by removing the electromagnetic wave. It is possible to have isolation effect over 40 dB with a conventional device sold in the market.

When coaxial cables are connected to the terminals 1 and 4, which are set up in the inside of the shielding box 1, and the cables are connected to a transmitting/receiving system by passing below the support 3 through the inside of an antenna device supporting unit 2 having a structure of a metal pipe. Otherwise, when the antennas are independently operated as bi-directional repeaters, the antenna can be independently operated by embodying receiving and transmitting devices including power supply unit in the inside of the shielding box 1.

Meanwhile, it is possible to make length of the coaxial cable connected to the terminals 2 and 3 equal and connect the coaxial cable to a power subtracting device such as a 180 hybrid combiner, a power divider+a phase delayer, and a T connector+a phase delayer.

In this case, isolation with respect to the intensity of a signal transmitted to the second and third antennas 20 and 30 from the first antenna 10 is deteriorated more than 6 dB, but there is an advantage that an omni-directional characteristic can be well maintained in comparison with a receiving power pattern.

FIG. 6 is a graph showing an S parameter characteristic of the ultra isolation antenna in accordance with the second embodiment of the present invention.

The ultra isolation antenna is manufactured in accordance with the second embodiment of the present invention to include the first antenna having a thickness of 0.2 cm and an entire length of 2.5 cm, the second antenna having a thickness of 0.2 cm and a size of 6 cm×2.6 cm, a shielding box of 2 cm×12 cm×10 cm and the shielding unit of 0.2 cm×10 cm×5.5 cm.

As shown in FIG. 6, in the first antenna, resonance is generated at 2.8 GHz, and in the second antenna, resonance is generated at 2.5 GHz.

Herein, S11 and S22 parameters maintain values less than −10 dB, and it means that impedance matching is well performed.

Since an S33 parameter has the same value as an S22 parameter, the S33 parameter is omitted in the drawing.

Also, when the terminal 1 is used as a transmitting terminal, that is, when the first antenna is used as a transmitting antenna, isolation, which is a rate that electromagnetic wave radiated through the transmitting antenna is abandoned in the second antenna, can be known by a S21 characteristic, and isolation is maintained at −106 dB as shown in the drawing.

Therefore, since isolation of more than 146 dB can be acquired in consideration of isolation improvement by the power summating device, it is possible to apply the above method to a system requiring more than 120 dB, which is most strictly applied in a mobile communication such as CDMA/TDMA.

Since isolation more than 100 dB can be acquired in a formation using a power summating device of the terminals 2 and 3, it is apparent that the structure is suitable for local wireless communication. The ultra broadband wireless communication system requires isolation more than 60 dB.

When the height of the shielding unit is raised, isolation can be increased higher, and although the shielding unit is removed, isolation more than 80 dB is maintained in a model of FIG. 6. When the power summating device is used, isolation more than 120 dB can be acquired.

FIG. 7 is a diagram showing a far-field radiation pattern of a perpendicular element in an H plane when a first antenna of the ultra isolation antenna is fed in accordance with the second embodiment of the present invention.

That is, FIG. 7 shows an electric field pattern with respect to a perpendicular polarization element by the first antenna, and H plane electric field pattern of θ=90 degree in the drawing.

Herein, a gain of 3 dBi means maintaining a semi-omni-directional characteristic. The direction of the main beam maintained at ϕ=270 and 90 degree and a beam bandwidth more than 0 dBi is maintained at about 60 to 120 and 240 to 300 degree in a direction of ϕ

Also, the beam is formed at around 0 and 180 degree and much higher omni-directional characteristic can be maintained when lowering height of the shielding unit or raising a grounding block of the shielding box, in which the first antenna is positioned (not shown in the drawing).

FIG. 8 is a diagram showing a far-field radiation pattern of a perpendicular element in an H plane when a power summating device is connected to terminals 2 and 3 of the ultra isolation antenna in accordance with the second embodiment of the present invention.

That is, FIG. 8 shows a perpendicular polarization electric field pattern in an H plane of θ=100 degree when the power summating device is connected to the second and third antennas in an ultra isolation antenna in accordance with the second embodiment of the present invention.

As shown in FIG. 8, the ultra isolation antenna suggested in the second embodiment of the present invention has a gain of 2.6 dBi and maintains a main beam band of more than 0 dBi, e.g., θ=35 to 75, 105 to 135, 215 to 245 and 285 to 315 degree.

Therefore, bi-directional communication is possible in bands of about 105 to 120 and 285 to 300 degree which are parts overlapped with the pattern of FIG. 7.

When the power summating device is connected to the second and third antennas of the isolation antenna, although a result of the horizontal polarization is not shown, it is shown that a band beam is formed in between −20 and 20 degree and between 160 and 200 degree. Herein, the gain of 5.3 dBi means that the gain is better than a perpendicular polarization.

Meanwhile, when a receiving rate for the perpendicular antenna and the horizontal antenna is set at 0 dB in the same direction, the receiving rate can be varied according to a distance and increase of reflected wave. Since a receiving rate of −6 dB is decreased in a general terminal of mobile communication, reception can be performed subsequently possible when the receiving rate of 0 dB is applied to a mobile communication field. That is, omni-directional reception is possible except 90 and 270 degree.

FIG. 9 is a diagram showing a far-field radiation pattern of a perpendicular element in an H plane of θ=100 degree when a power subtracting device is connected to the terminals 2 and 3 of the ultra isolation antenna in accordance with the second embodiment of the present invention.

As shown in FIG. 9, when a power subtracting device is connected to the second and third antennas of an ultra isolation antenna of the present invention, the perpendicular polarization electric field pattern shows a comparatively semi-omni-directional pattern.

In case of the horizontal polarization (not shown in the drawing), omni-directional receiving is possible since the main beam is formed between 0 and 180 degree. A horizontal polarization gain is 2.6 dBi, and it is the same as the result of FIG. 8.

FIG. 10 is a cross-sectional plane view showing an ultra isolation antenna in accordance with a third embodiment of the present invention.

As shown in FIG. 10, the third embodiment of the present invention shows a case that sets up feeding inside pins of the second and third antennas in the same connecting direction.

An electrical characteristic of a case connecting the second and third antennas with a power summating device of the third embodiment is the same as an electrical characteristic of a case connecting the second and third antennas with a power subtracting device of the second embodiment, and the same characteristic can be acquired by an opposite method.

FIG. 11 is a perspective view showing an ultra isolation antenna in accordance with a fourth embodiment of the present invention.

As shown in FIG. 11, the ultra isolation antenna of the present invention can be set up by raising a middle part of the shielding box 1 to avoid an influence by the shielding unit when the first antenna 10 radiates a signal to a free space.

The above case shows a characteristic that isolation descends lower than when the cover is set up in a case, but it is possible to acquire isolation of more than 80 dB between the first and second antennas since the isolation more than 80 dB is maintained although the shielding unit is removed from a structure of the above-mentioned embodiment.

It is predictable that the isolation can be acquired more than 120 dB in consideration of isolation by the power subtracting device.

In the structure of the fourth embodiment shown in FIG. 11, since the first antenna 10 maintains an omni-directional characteristic, it is very suitable for a case that users exist in omni-directions and a communication distance of a base station should be extended by using a bi-directional repeater in a condition that the based station is in a certain direction.

FIG. 12 is a perspective view showing an ultra isolation antenna in accordance with a fifth embodiment of the present invention.

As shown in FIG. 12, the fifth embodiment of the present invention has a shielding box 1 having the same structure as the fourth embodiment of FIG. 11, and all of the first antenna 10, the second antenna 20 and the third antenna 30 have a structure realized as a monopole antenna.

When all of the three antennas are used as the same antennas, isolation will be reduced.

However, since a reader of a passive radio frequency identification (RFID) requires transmitting/receiving isolation of more than 30 dB, the three antennas can be used as the reader of the RFID.

Also, when the monopole antenna is realized as an antenna device of a spherical shape or a square, a broadband characteristic can be acquired.

Meanwhile, since an ultra wide band (UWB) communication has short usable distance and bi-directional communication is possible in isolation of more than 60 dB, co-channel and co-polarization bi-directional communication is possible in an ultra broadband communication field.

The present application contains subject matter related to Korean patent application No. 2004-0109401, filed in the Korean Intellectual Property Office on Dec. 21, 2004, the entire contents of which are incorporated herein by reference.

While the present invention has been described with respect to certain preferred embodiments, it will be apparent to those skilled in the art that various changes and modifications may be made without departing from the scope of the invention as defined in the following claims.

The invention claimed is:

1. A transmitting/receiving ultra isolation antenna for maintaining high isolation between a transmitting signal and a receiving signal, comprising:

a shielding box having a vacant space inside;

a first antenna mounted onto the shielding box;

a second and a third antennas mounted onto the shielding box which are symmetrically positioned in a same distance from the first antenna;

a shielding means mounted onto the shielding box symmetrically positioned between the first and second antennas and between the first and third antennas; and a reflection signal removing means for removing a signal transmitted to the second and third antennas from the first antenna.

2. The ultra isolation antenna as recited in claim 1, wherein the shielding box is positioned in a lower part of the first antenna, the second antenna, the third antenna, and the shielding means and having a structure covered by electric conductor entirely and has coaxial cable connectors mounted onto the shielding box within the vacant space inside such that the coaxial cable connectors are coupled to the first, second and third antennas.

3. The ultra isolation antenna as recited in claim 1, wherein the shielding means has a wall structure of an electric conductor.

4. The ultra isolation antenna as recited in claim 1, wherein the reflection signal removing means is connected to the second and third antennas with a cable of a same length.

5. The ultra isolation antenna as recited in claim 2, wherein the reflection signal removing means removes radiation signal from the first antenna by using power difference with respect to an input terminal of the second and third antennas.

6. The ultra isolation antenna as recited in claim 1, wherein a direction of a feeding means of the second and third antennas is perpendicular to a direction of a feeding means of the first antenna to increase isolation.

7. The ultra isolation antenna as recited in claim 1, wherein the second and third antennas are directional antennas and a main beam of the second antenna is in an opposite direction from a main beam of the third antenna.

8. The ultra isolation antenna as recited in claim 1, wherein the second and third antennas have a same shape and are formed of a same material.

9. The ultra isolation antenna as recited in claim 2, wherein the reflection signal removing means removes a signal from the first antenna based on power summation with respect to input terminals of the second and third antennas.

10. The ultra isolation antenna as recited in claim 9, wherein the feeding means of the second and third antennas are in opposite direction each other.

11. The ultra isolation antenna as recited in claims 1, wherein the first antenna is a monopole antenna, and the second and third antennas are loop antennas.

12. The ultra isolation antenna as recited in claims 1, wherein the first to third antennas are monopole antennas.

13. The ultra isolation antenna as recited in claims 1, wherein the first to third antennas use any one among a loop antenna, a monopole antenna, a dipole antenna, a horn antenna, a double ridged horn antenna and a reflector antenna.

14. The ultra isolation antenna as recited in claims 1, wherein the first antenna to third antennas use any one among a square, a circular and spherical ultra broadband antennas.

15. A transmitting/receiving ultra isolation antenna for maintaining high isolation between a transmitting signal and a receiving signal, comprising:

a first antenna mounted onto the shielding box;

a second and a third antenna mounted onto the shielding box which are symmetrically positioned in a same distance from the first antenna;

the shielding box having a vacant space inside which is positioned in a lower part of the first antenna, the second antenna and the third antenna and has a structure covered by electric conductor; and a reflection signal removing means for removing a signal transmitted from the first antenna to the second and third antennas.

16. The ultra isolation antenna as recited in claim 15, wherein the shielding box has a symmetrical structure that a central part where the first antenna is positioned is higher than left and right parts where the second and third antennas are positioned.

* * * * *